US008662048B2

(12) United States Patent
Laimboeck

(10) Patent No.: US 8,662,048 B2
(45) Date of Patent: Mar. 4, 2014

(54) SYMMETRIC EXTENDED PORTING

(75) Inventor: Franz Laimboeck, Goleta, CA (US)

(73) Assignee: Mahle Koenig Kommanditgesellschaft GmbH & Co. KG, Rankweil (AT)

( * ) Notice: Subject to any disclaimer, the term of this patent is extended or adjusted under 35 U.S.C. 154(b) by 70 days.

(21) Appl. No.: 13/490,662

(22) Filed: Jun. 7, 2012

(65) Prior Publication Data

US 2013/0008403 A1 Jan. 10, 2013

Related U.S. Application Data

(60) Provisional application No. 61/494,038, filed on Jun. 7, 2011.

(51) Int. Cl.
*F02F 1/00* (2006.01)

(52) U.S. Cl.
USPC ..... 123/193.2; 123/65 P; 123/65 PE; 123/65 A; 123/65 EM; 123/51 BD

(58) Field of Classification Search
USPC ..... 123/193.2, 65 P, 65 PE, 65 A, 65 EM, 123/51 BD
See application file for complete search history.

(56) References Cited

U.S. PATENT DOCUMENTS

| | | | | |
|---|---|---|---|---|
| 4,362,132 | A * | 12/1982 | Neuman | 123/73 D |
| 5,136,989 | A * | 8/1992 | Sterbenz et al. | 123/65 PE |
| 6,016,776 | A * | 1/2000 | Jonsson | 123/65 A |
| 6,367,432 | B1 * | 4/2002 | Araki | 123/73 R |

* cited by examiner

*Primary Examiner* — Marguerite McMahon
*Assistant Examiner* — James Kim
(74) *Attorney, Agent, or Firm* — Laurence A. Greenberg; Werner H. Stemer; Ralph E. Locher

(57) ABSTRACT

A cylinder of an externally fired, two-stroke engine has at least two exhaust channels. At least the inflow openings of the exhaust channels are located or formed symmetrical in relation to a plane of symmetry containing a longitudinal center axis of the cylinder. The inflow openings of the exhaust channels lying above each other in the cylinder wall surface and spaced apart by wall webs lie distributed over a peripheral region of the cylinder wall surface which in relation to the longitudinal center axis corresponds to a central angle Z of 175°≤Z≤280°, preferably 180°≤Z≤265°.

20 Claims, 7 Drawing Sheets

Exhaust channel with 3 webs
Piston bolt track covered by webs
5 overflow channels

SYMMETRIC EXTENDED PORTING

CROSS-REFERENCE TO RELATED APPLICATION

This application claims the benefit, under 35 U.S.C. §119 (e), of provisional patent application No. 61/494,038, filed Jun. 7, 2011; the prior application is herewith incorporated by reference in its entirety.

BACKGROUND OF THE INVENTION

Field of the Invention

The invention concerns a cylinder of an externally fired, two-stroke engine with at least two exhaust channels. Furthermore the invention concerns a two-stroke engine with at least one such cylinder.

The object of the invention is to optimize the flow conditions inside a cylinder of this type so as to increase the efficiency of such a cylinder in use, and allow such a cylinder to be manufactured as easily as possible and have a low weight. Furthermore the ignition behavior of engines with such cylinders should be improved.

These objects are achieved with a cylinder of the type cited initially with the features as claimed. Accordingly it is proposed that at least the inflow openings of the exhaust channel are formed or located symmetrical in relation to a plane of symmetry containing the longitudinal center axis of the cylinder and that the inflow openings of the exhaust channels lying above each other in the cylinder wall surface and spaced by wall webs lie distributed over a peripheral region of the cylinder wall surface which in relation to the longitudinal center axis corresponds to a central angle Z of $175° < Z \leq 280°$, preferably $180° \leq Z \leq 265°$.

By arranging the inflow openings of the exhaust channels through which the exhaust gas produced in the cylinder chamber is discharged, over a correspondingly large peripheral region of the cylinder wall surface, the throughput of gas through the cylinder is improved and a more precise separation achieved between fresh gas and exhaust gas, improving the combustion behavior. Furthermore it is thus possible to make the total cross-section of the existing exhaust channels correspondingly larger so that the throughput and combustion are improved. The webs delimiting the exhaust channels can be designed favorable to flow so that the exhaust gases can be discharged with little turbulence.

The peripheral region of the cylinder wall surface opposite the exhaust line and free from exhaust channels is designed such that with its length it can guide the gases flowing to the exhaust channels adequately in order largely to prevent a turbulence of the fresh gases and exhaust gases.

A constructionally simple embodiment is achieved if the exhaust channels are merged into a common exhaust line which is formed symmetrical in relation to the plane of symmetry.

The cylinder is constructed symmetrical in relation to an axis of symmetry which advantageously runs perpendicular to the rotation axis of the driven crankshaft. Both the inflow openings of the exhaust channels and the mouths of the overflow channels lie symmetrical to this plane of symmetry. The same applies to the exhaust channels and to the overflow channels and the exhaust line. These symmetry conditions are observed as precisely as possible.

It is advantageous if a wall web is formed between the inflow openings of the exhaust channels in an angular region of 75° to 105°, preferably 80° to 100° measured from the exhaust side intersection, lying at 0°, of the cylinder inner wall with the plane of symmetry. The formation of such a wall web in this region allows the use of pistons with a recess in the shaft wall surface for installation of the piston bolt through this recess into the piston carrier, in order to be able to hinge a connecting rod pivotably on the piston oscillating in the cylinder. The width of this angular region depends on the width of the recess in the peripheral direction of the piston; as the aim is to keep such recesses as small as possible, this angular region is advantageous.

By distributing the inflow openings of the exhaust channels over a peripheral region which extends over a wide region, preferably over more than 90°, on both sides of the plane of symmetry, it is possible to provide lines for a coolant medium in the webs which lie between the inflow openings or delimit these laterally. Depending on the thickness or width of these webs, at least one line for a coolant medium can be provided in each web.

A cylinder design is advantageous in which it is provided that overflow channels open into the cylinder chamber in the wall region located below the wall region with the inflow openings of the exhaust channels, wherein at least the mouths of the overflow channels are formed or located symmetrical in relation to the plane of symmetry. This ensures optimum use of space in the region of the exhaust line with precise separation of the inflow of fresh gas and the outflow of exhaust gas.

In an alternative embodiment it is possible that the outflow channel lying in the plane of symmetry or the two outflow channels lying closest to the plane of symmetry is or are each expanded with a flow chamber extending in the wall region of the cylinder inner wall in which the overflow channels are formed, which chamber opens into the cylinder chamber in the wall region lying between two mouths of the overflow channels. By a corresponding choice of flow speeds and for specific applications, this design of the exhaust channels can be advantageous without leading to undesirable mixing of fresh gas and exhaust gas.

It is particularly advantageous to use a piston in such a cylinder, wherein a connecting rod with a big-end bearing is pivotably hinged on the piston with a piston bolt extending perpendicular to the plane of symmetry. The pressure exerted on the piston on combustion is spread evenly over the piston surface so that the connection of the piston with a rigid piston rod, the movement of which is guided, is not required.

It is furthermore advantageous if it is provided that the shaft wall of the piston in the region of the big-end bearing carried by the piston bolt has at least on one side a mounting recess for installation of the piston bolt, and that a wall web is formed in the angular region of the cylinder inner wall which is swept by the mounting recess on the piston stroke. Thus pistons with mounting recesses in the shaft wall of the cylinder can be used.

The structure of the piston is simplified if at least the wall web lying closest to the exhaust line or at least the two wall webs lying closest to the exhaust line—viewed in the longitudinal direction of the cylinder—extend both into the wall region with the inflow openings of the exhaust channels and into the wall region with the mouths of the overflow channels. It is constructionally advantageous to form as many webs between the exhaust channels as possible continuous so that they delimit both the inflow openings and the mouths.

For the inflow openings of the exhaust channels and/or the mouths of the overflow channels extending over the large peripheral region, it is advantageous if the inflow direction of at least one exhaust channel and/or the outflow direction of at least one overflow channel is tilted at a specified angle in the direction of the cylinder chamber end on the combustion chamber side. Thus the combustion properties of the cylinder are improved.

Thus the tilt angle increases as the distance from the exhaust line increases. The tilt angle of an overflow channel lying below the exhaust line advantageously is approximately 0°. Suitably the tilt angle of an overflow channel lying below the exhaust line is $-3° \leq N \leq +5°$, preferably $-2° \leq N \leq +3°$. For the exhaust channels and/or overflow channels lying closest to the exhaust line, $0° \leq N \leq 7°$, preferably $0° \leq N \leq 5°$; for the next exhaust channels and/or overflow channels along the periphery $0° \leq N \leq 20°$, preferably $5° \leq N \leq 17°$; and for overflow channels lying further away from the exhaust line 5, $50° \leq N \leq 70°$.

A reduction in turbulence of the exhaust gases and hence an improvement in combustion is achieved if the edge on the combustion chamber side of the inflow openings of the exhaust channels is rounded, wherein the rounding advantageously has a radius of 0.4 to 1 mm, preferably 0.4 to 0.6 mm.

For combustion control in a cylinder according to the invention, it is advantageous if a displaceable slide valve protrudes into the exhaust channel lying in the plane of symmetry or into the two exhaust channels lying closest to the plane of symmetry, the end edge of which slide valve protruding into the respective channel defines an adjustable exhaust control edge.

It is advantageous furthermore if the length of the piston skirt in the region of the mouths of the overflow channels located below the exhaust line is smaller by the height of the mouths of the overflow channels than the inner wall surface of the cylinder swept by the piston skirt. Thus a substantial weight saving can be achieved in the piston.

A particularly advantageous design of cylinder with which the above-mentioned advantages according to the invention are achieved is characterized in that the mouths of the overflow channels are located in the cylinder chamber below the wall region with the inflow openings of the exhaust channels, wherein at least the mouths of the overflow channels are located or formed symmetrical in relation to the plane of symmetry, that the inflow direction of at least one exhaust channel and/or the outflow direction of at least one overflow channel is tilted at an angle in the direction of the cylinder chamber end on the combustion chamber side, wherein the angle of tilt of the inflow direction or outflow direction increases successively as the distance from the exhaust line increases, and that the angle of tilt of an overflow channel lying below the exhaust line is $-3° \leq N \leq +5°$, preferably $-2° \leq N \leq +3°$, to a plane standing perpendicular to the cylinder axis.

The invention is explained in more detail below as an example with reference to the drawing.

DESCRIPTION OF THE INVENTION

Figure 1:
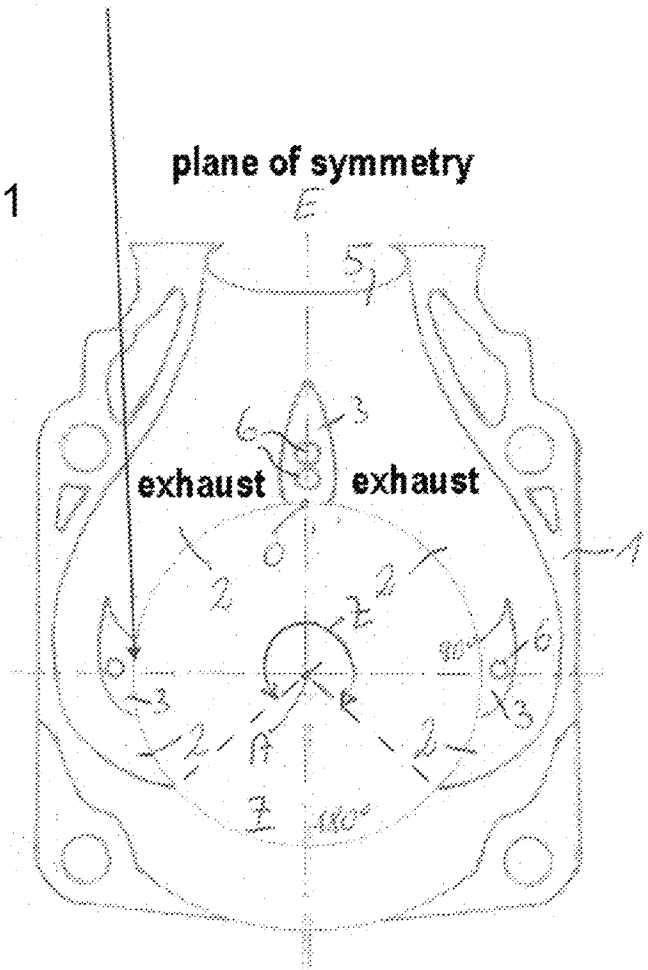
FIG. 1 shows a section through a cylinder according to the invention at height X as shown in FIG. 3.
Figure 3:
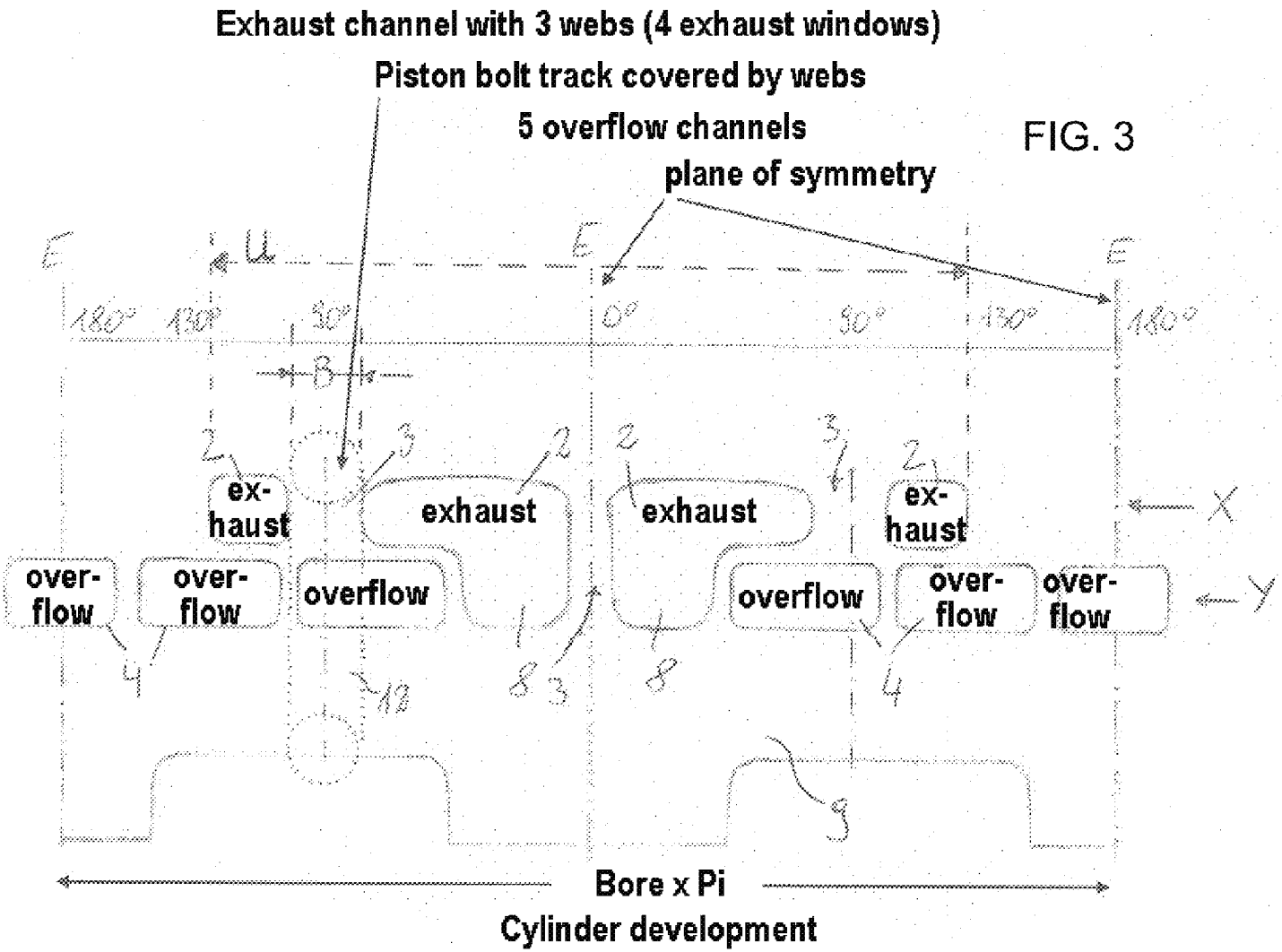
FIG. 3 shows a development of the cylinder inner wall surface with the inflow openings of the exhaust channels and the mouths of the overflow channels.

FIG. 1 shows a cylinder of an externally fired two-stroke engine in a section perpendicular to the cylinder longitudinal axis A at height X of the exhaust channels according to FIG. 3. A number of exhaust channels 2—in the present case four exhaust channels—is formed symmetrical to the plane of symmetry E in cylinder 1, these channels opening with their inflow openings into the cylinder chamber 7. At height level Y there is a number of overflow channels 4 delivering fresh gas which open with their mouths into the cylinder. At the height of the overflow channels 4 lie also part segments of exhaust lines 2 which—as evident from FIG. 3 which shows a development of the cylinder inner wall—comprise flow chambers 8 which lie in the height region in which the mouths of the overflow channels 4 open into the cylinder.

E designates the plane of symmetry of cylinder 1. It is proposed that both the exhaust channels 2 and the overflow channels 4, and the inflow openings and the mouths, are formed symmetrical in relation to the plane of symmetry E. The exhaust channels 2 merge together into one exhaust line 5 which lies symmetrical to the plane of symmetry E.

The exhaust channels 2 extend in the cylinder wall surface 9 over an angular region Z. This angular region has a peripheral extent corresponding to $175° \leq Z \leq 280°$. Advantageously this angular extent is $180° \leq Z \leq 265°$. Thus the cross-sections or areas of the inflow openings through which the exhaust gas flows into the exhaust channels 2 can be enlarged and it is possible to form lines 6 for a coolant medium in the webs 3 lying between the exhaust channels 2.

The web which lies closest to the exhaust line 5—as evident from FIG. 3—can be formed both over the height region in which the exhaust channels 2 are located and in the region in which the overflow channels 4 are located, i.e. as evident from FIG. 3, over the region of the exhaust channels 2 and the overflow channels 4, and is formed symmetrical in relation to the plane of symmetry E. In this web 3—as in the further webs 3—lines 6 for coolant medium can be provided. In principle all webs 3 between the exhaust channels 2, in particular at the level of the overflow channels 4, can be formed continuous and thus also delimit the overflow channels 4.

It is advantageous if in such a cylinder a piston is arranged on which a connecting rod with a big-end bearing is pivotably hinged with a piston bolt extending perpendicular to the plane of symmetry E. If the shaft wall of the piston in the region of the big-end bearing carried by the piston bolt has a mounting recess at least on one side, a wall web 3 can be formed in the region of the cylinder inner wall 9 which is swept by the mounting recess on the piston strokes. The surface 12 of the cylinder wall 9 swept by a recess in the piston is drawn in dotted lines in FIG. 3 and lies in the region of a formed web 3. Thus an undesirable overflow of combustion gas into the crankcase is avoided.

FIG. 3 shows the position of the inflow openings of the exhaust channels 2 and the mouths of the overflow channels 4. The point designated O in FIG. 1 constitutes the intersection of the plane of symmetry E with the cylinder inner wall surface 9 and is the starting point for counting the degrees of the central angle Z, the apex of which lies in the cylinder longitudinal axis A. It is evident that there is a web 3 at 0° which is located between the two exhaust channels 2 lying closest to the exhaust line 5. In the present case, the angular region on both sides of this web 3 extends to an angle of around 130°, so that in total an angular region for the individual exhaust channels 2 results which amounts to around 260°. This facilitates the formation of the exhaust channels 2 and the construction of the cylinder, and improves the flow conditions within the cylinder chamber 7.

The individual overflow channels can be arranged distributed over the entire periphery of the cylinder inner wall 9. In the present case, the overflow channels 4 are interrupted by the flow chambers 8 also provided which are connected to the exhaust channels 2 at the bottom to enlarge these.

Figure 2:
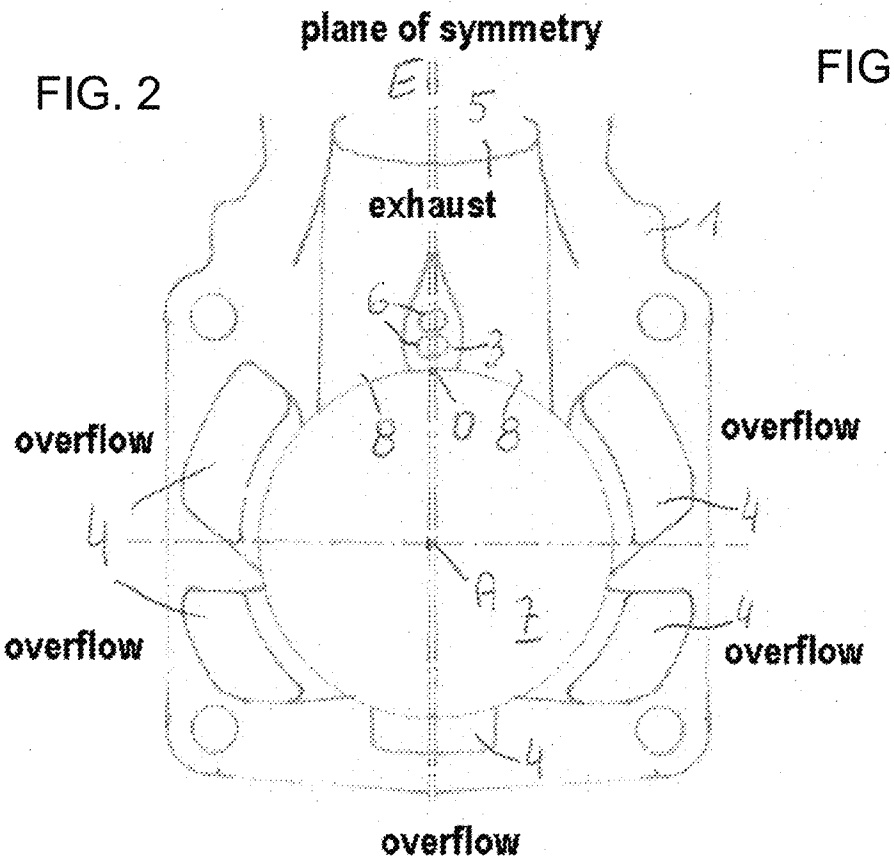
FIG. 2 shows a section at height Y as shown in FIG. 3.
Figure 4:
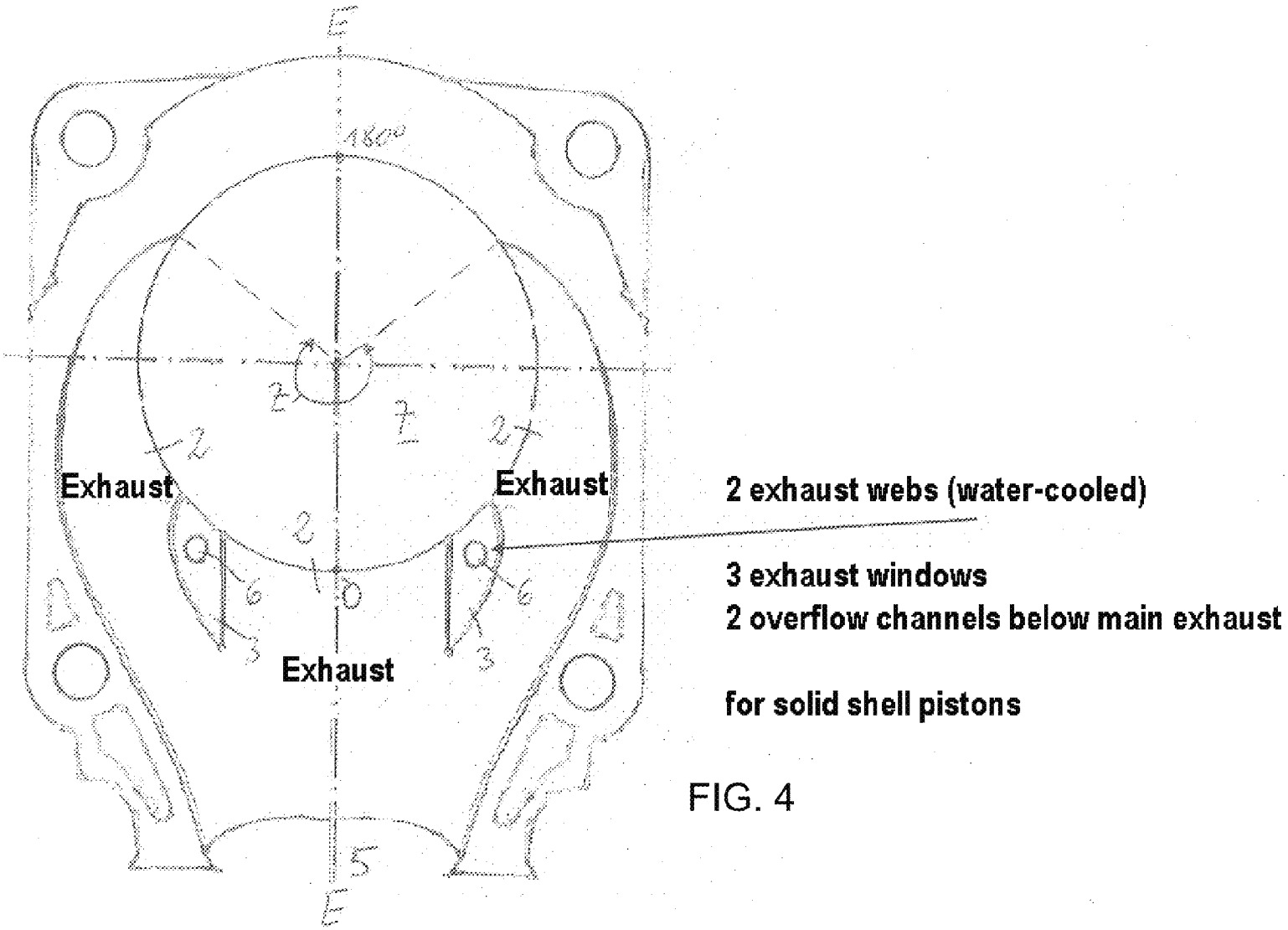
FIG. 4 shows a section according to plane X through an alternative embodiment of a cylinder as shown in development in FIG. 6.
Figure 5:
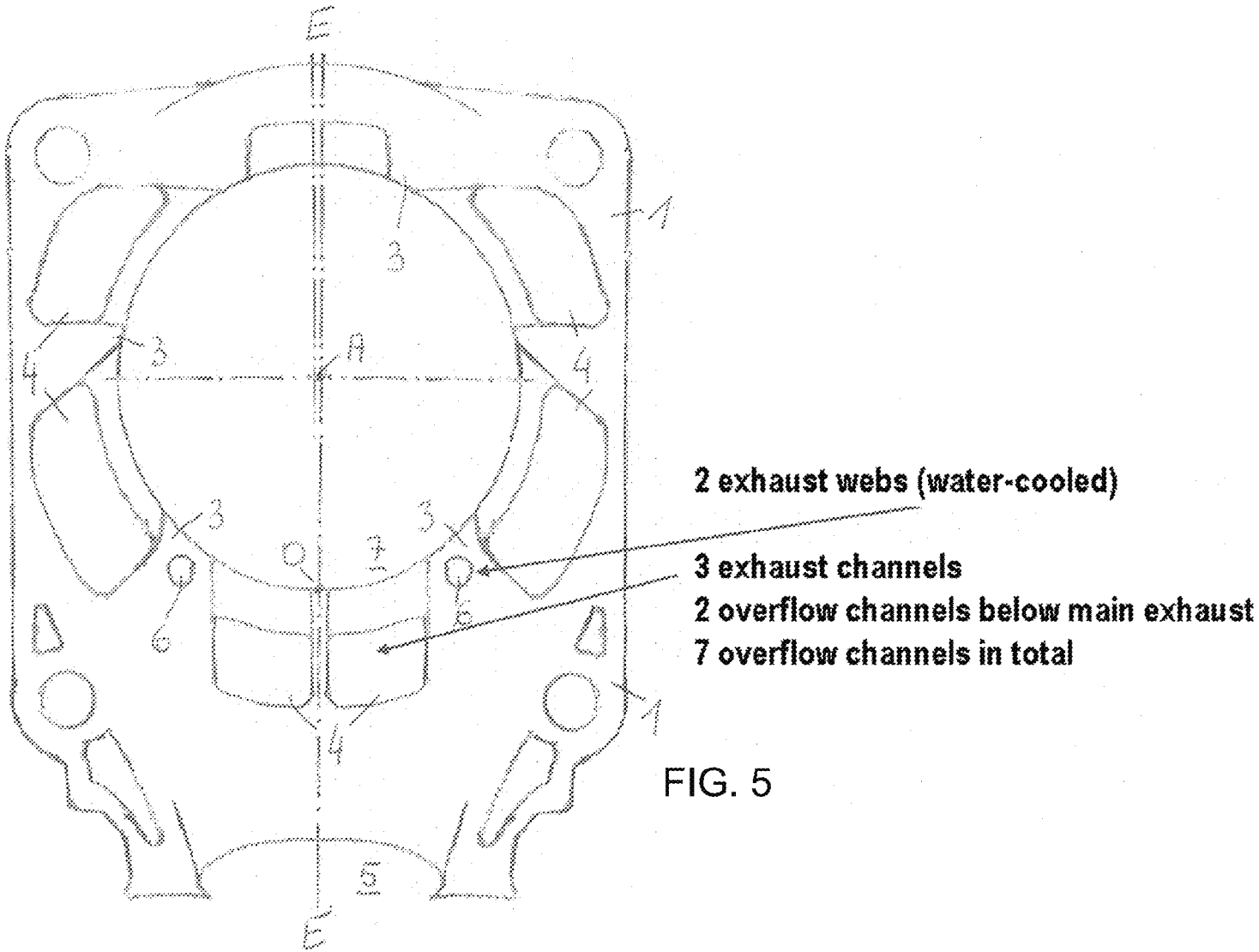
FIG. 5 shows a section in plane Y in a cylinder development as shown in FIG. 6.
Figure 6:
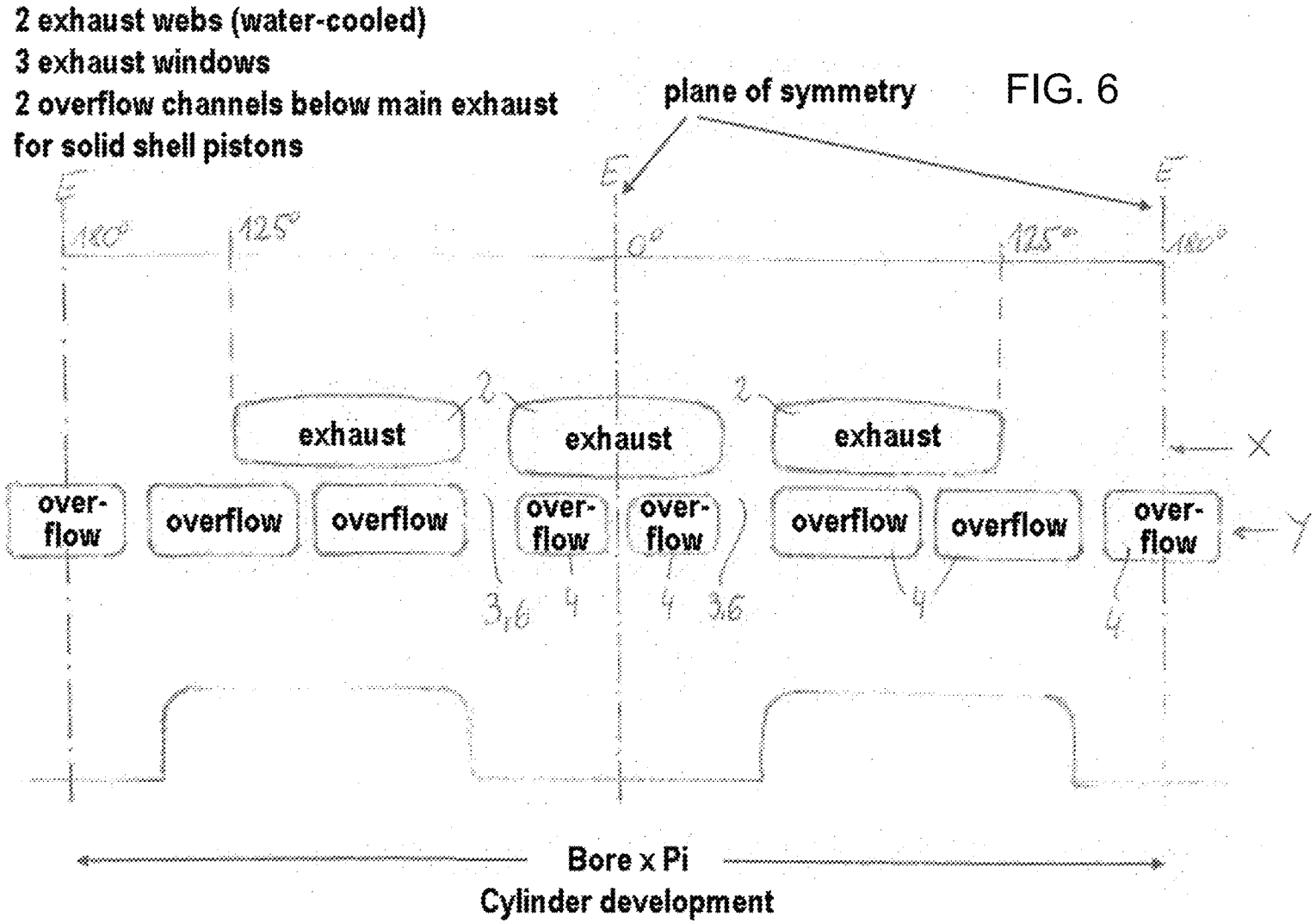
FIG. 6 shows a development of the cylinder wall surface of a cylinder according to the invention with the inflow openings of the exhaust channels and the overflow channels.

FIGS. 1 to 3 show a cylinder with an even number—namely four—of exhaust channels 2. FIGS. 4, 5 and 6 show a cylinder with an odd number—namely three—of exhaust channels 2. Because of the requirement for symmetry, one exhaust channel 2 must therefore lie directly in the plane of symmetry E. This exhaust channel is the exhaust channel which opens directly into the exhaust line 5.

The number of overflow channels 4 can be even or odd; in the embodiments shown in FIGS. 1 to 3 and 4 to 6, the number of overflow channels 4 has been selected as odd.

In the embodiments of a cylinder shown in FIGS. 4 to 6, three exhaust channels 2 are present which are delimited by two webs 3. Lines 6 for a coolant medium are formed in the webs 3. The exhaust channels 2 extend on both sides of the plane of symmetry E over a central angular region Z of around 125° so that they are distributed over a total angular region of around 250°. A peripheral region of around 110° remains free from inflow openings of exhaust channels 2. The webs 3 can also be formed continuous if the positions of the mouths of the overflow channels are modified.

As shown from the development in FIG. 6, two overflow channels 4 lie below the centrally located exhaust channel 2.

Figure 7:
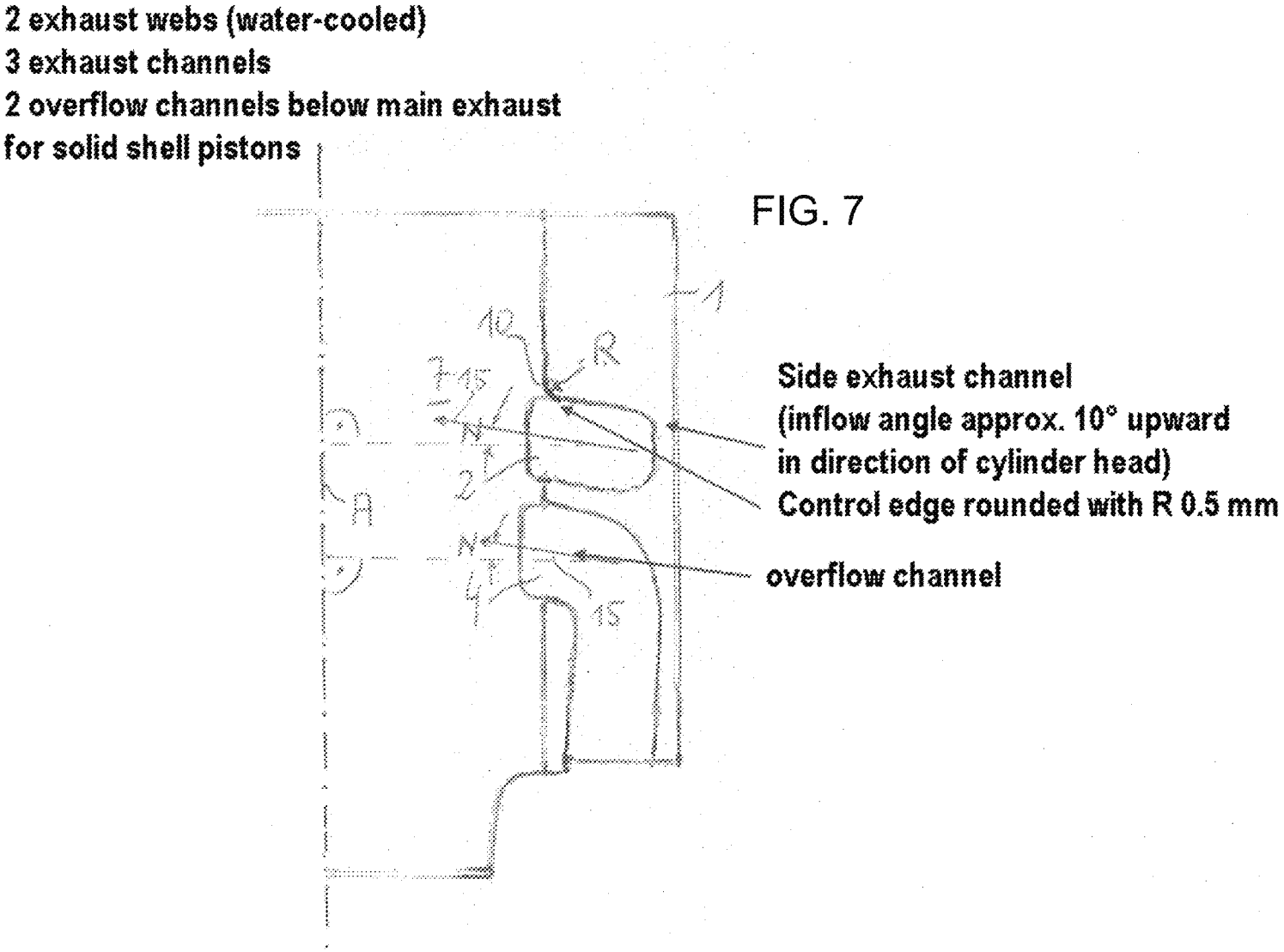
FIG. 7 shows a schematic section through an exhaust channel and an overflow channel.

FIG. 7 shows schematically a section through a cylinder according to the invention in a plane which contains the longitudinal axis A and both an inflow opening of an exhaust channel 2 and a mouth of an overflow channel 4. The inflow direction 15 of the exhaust channels 2 provided and the outflow direction 15 of the overflow channels 4 provided can be tilted at specified angles N in the direction towards the end of the cylinder chamber 7 on the combustion chamber side. The tilt increases as the distance from the outflow line 5 increases. It is provided that the tilt angle N of an overflow channel 4 lying below the exhaust line 5 is $-3° \leq N \leq +5°$, preferably $-2° \leq N \leq +3°$. For the exhaust channels 2 and/or overflow channels 4 lying closest to the exhaust line 5, $0° \leq N \leq 7°$, preferably $0° \leq N \leq 5°$; for the next exhaust channels 2 and/or overflow channels along the periphery, $0° \leq N \leq 20°$, preferably $5° \leq N \leq 17°$; and for overflow channels lying further away from the exhaust line 5, $50° \leq N \leq 70°$.

It is advantageous for an improvement in combustion or gas dissipation if, as shown in FIG. 7, the edge 10 on the combustion chamber side of the outflow openings of the exhaust channels 2 is rounded, wherein the rounding has a radius 0.4 to 1 mm, preferably 0.4 to 0.6 mm. The inflow direction and outflow direction are opposite each other; the angle N between a plane perpendicular to the cylinder axis and the respective direction as shown in FIG. 7 is measured and is valued as positive in the direction of the top dead center.

Figure 8:
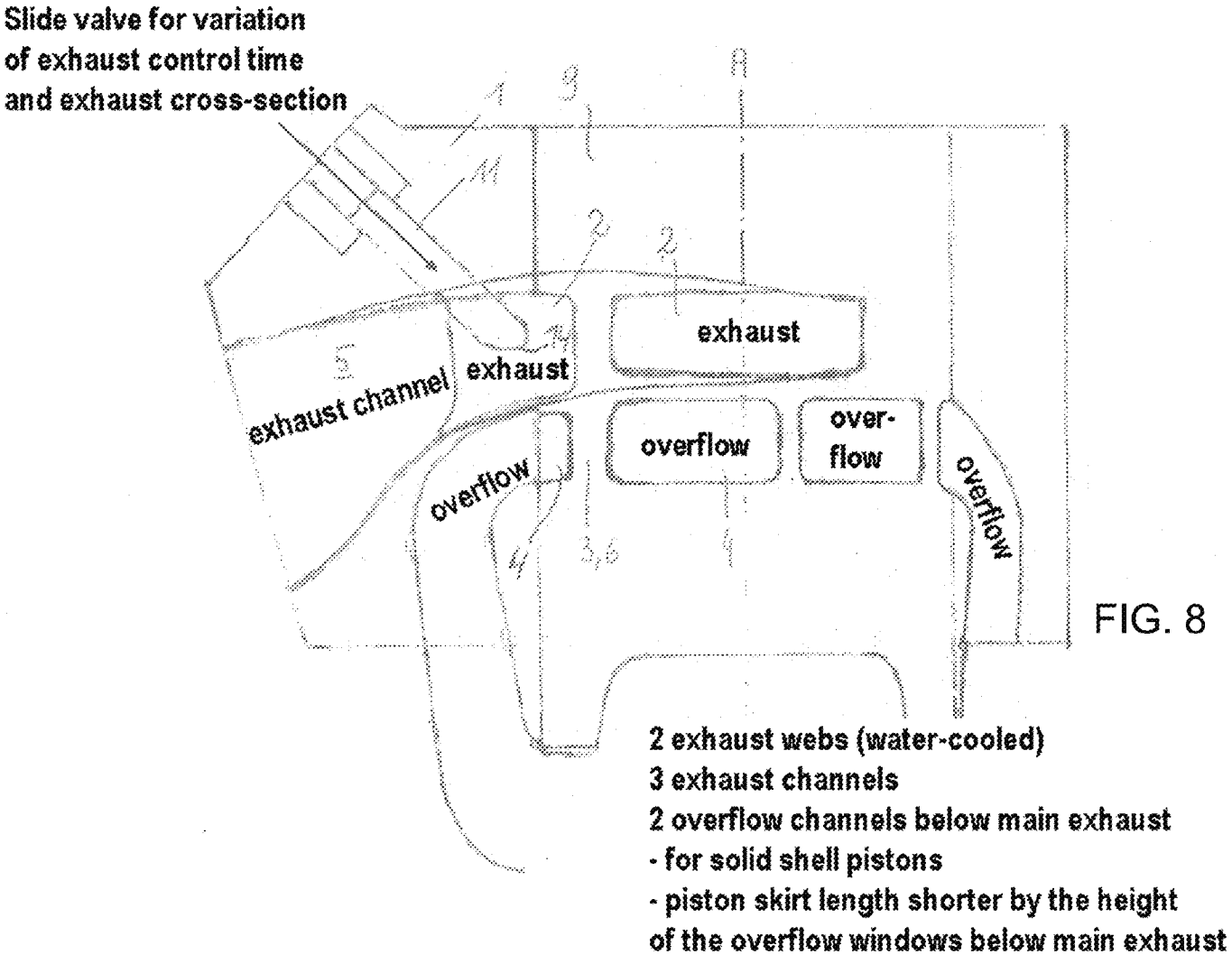
FIG. 8 shows a schematic development of the cylinder wall surface wherein a slide valve is arranged in the exhaust channel leading directly to the exhaust line.

FIG. 8 shows a schematic section along the plane of symmetry E of the cylinder wall surface 9 of a cylinder according to the invention as shown in FIG. 4. In this embodiment, a slide valve 11 is arranged in or protrudes into the exhaust channel 2 located centrally in the plane of symmetry E. This slide valve 11 is mounted displaceably and can modify the cross-section of the exhaust channel. The end edge of the slide valve 11 located in the exhaust channel 2 changes the cross-section of the exhaust channel. With such a slide valve, the height of the exhaust control edge which is defined by the edge of the slide valve 11 is modified. Thus the exhaust control time can be modified and the exhaust cross-section can be made adjustable.

In an embodiment with two separate exhaust channels located symmetrically to the plane of symmetry E, such a slide valve 11 can have a slot in the center to take into account the web 3 located between the exhaust channels.

Furthermore such a slide valve need not terminate closely against the cylinder wall or the slide valve at its control edge can have a distance of around 0.7 mm from the piston skirt in the lowest position.

Advantageously the length of the piston skirt in the region of the mouths of the overflow channels 4 located below the exhaust line 5 is smaller by the height of the mouths than the inner wall surface 9 of the cylinder swept by the piston stroke.

The cylinder according to the invention is a cylinder for an externally fired, reverse-flushed two-stroke engine. A number of such cylinders can be arranged combined in one engine block.

As is evident from the individual figures, the webs 3 are guided favorably to flow and offer the minimum resistance to the gases guided through the channels. As is evident from FIG. 3, the flow chambers 8 lie symmetrical to the plane of symmetry E.

Insofar as an even number of exhaust channels 2 is provided, a web is located at angle 0° otherwise a symmetrical arrangement of exhaust channels 2 would not be possible.

A cylinder is particularly advantageous in which overflow channels 4 open into the cylinder chamber 7 below the wall region with the inflow openings of the exhaust channels 2, below the inflow openings of the exhaust channels, wherein at least the mouths of the overflow channels 4 are located or formed symmetrical in relation to the plane of symmetry E, the inflow direction of at least one exhaust channel 2 and/or the outflow opening of at least one overflow channel 4 is tilted at an angle N in the direction towards the end of the cylinder chamber 7 on the combustion chamber side, wherein the tilt angle N of the inflow direction or outflow direction increases successively as the distance from the exhaust line 5 increases, and the tilt angle N of an overflow channel 4 lying below the exhaust line 5 is $-3° \leq N \leq +5°$, preferably $-2° \leq N \leq +3°$, to a plane standing perpendicular to the axis of symmetry.

If the overflow channels open into the cylinder chamber below the wall region with the inflow openings of the exhaust channels, there is optimum use of space in the region of the exhaust line with precise separation of the inflow of fresh gas and outflow of exhaust gas.

Above all, for the inflow openings of the exhaust channels and/or the mouths of the overflow channels extending over the large peripheral region it is advantageous if the inflow direction of at least one exhaust channel and/or the outflow direction of at least one overflow channel is tilted at a specific angle in the direction towards the end of the cylinder chamber on the combustion chamber side. Thus the combustion properties of the cylinder are improved.

It is furthermore provided quite generally that at least partly one or more mouths of the overflow channels 4 are located below an arbitrary number of, preferably all, inflow openings of the exhaust channels 2. For example according to FIG. 3, one part region of a mouth lies below each of two central inflow openings. It would also be possible here with a correspondingly wider inflow opening to arrange more than one mouth e.g. one or more mouths and/or part regions of mouths. Also inflow openings lying above each other can lie above the same mouth. In the design of the inflow openings and mouths, the position of the wall webs 3 is taken into account and vice versa.

The embodiment according to FIGS. 1 and 3 is suitable for pistons with longitudinal slots for mounting piston bolts, wherein the slot covers the wall web 3 lying in the angular region of 75° to 105°.

Both the inflow direction 15 and the outflow direction 15 enclose with a plane perpendicular to the cylinder axis an acute tilt angle N, the apex of which lies radially outwards as is evident from FIG. 7.

As shown in FIGS. 3 and 6, two mouths of overflow channels 4 lie below the inflow openings of the central exhaust channels 2. It can be provided here that one or more mouths, or also part regions of mouths of overflow channels 4, lie below an inflow opening of an exhaust channel. For example FIG. 6 shows that two mouths of overflow channels 4 are located below an inflow opening of an exhaust channel 2. Similarly below this centrally located exhaust channel lies one mouth, or one mouth and two part regions of mouths adjacent on both sides or of two mouths or three mouths. According to the invention it is advantageous that two mouths of overflow channels 4 are located below the inflow openings of the exhaust channels 2. In particular this applies to the centrally located exhaust channel or the two centrally located exhaust channels 2 i.e. the inflow opening of an exhaust channel 2 lying closest to the plane of symmetry E at central angle 0°.

As further shown in FIGS. 3 and 6, the inflow openings of the exhaust channels 2 extend over a particular central angular region Z while the mouths of the overflow channels 4 can extend over a larger central angular region than the inflow openings of the exhaust channels 2. It is however advantageous that at least one part region of a mouth of an overflow channel 4 or at least one mouth lies below the or both inflow openings lying centrally in the region of 0° or the adjacent central angular region. This substantially improves the throughflow behavior of the cylinder.

This flow directions 15 shown in FIG. 7 for both the inflow into the exhaust channel 2 and the outflow from an overflow channel 4 are understood as the direction of flow i.e. the direction of the respective gas jet into or out of the respective channel. Turbulence or flow distortions in the peripheral region of the respective flow are not considered, or a flow direction results lying in the center region of the respective flow which is taken as the flow direction to determine the angle N.

The invention claimed is:

1. A cylinder of an externally fired, two-stroke engine, comprising:

a cylinder inner wall defining a longitudinal center axis of the cylinder;

at least two exhaust channels formed with inflow openings in the cylinder wall, said inflow openings of said exhaust channels being located symmetrically in relation to a plane of symmetry containing said longitudinal center axis of the cylinder; and said inflow openings of the exhaust channels following one another in said cylinder wall surface and being spaced apart by wall webs lie distributed over a periphery of said cylinder wall surface that corresponds, relative to said longitudinal center axis, to a central angle Z of $175° \leq Z \leq 280°$.

2. The cylinder according to claim 1, wherein said central angle Z is $180° \leq Z \leq 265°$.

3. The cylinder according to claim 1, wherein said exhaust channels are merged together into a common exhaust line formed symmetrically relative to said plane of symmetry.

4. The cylinder according to claim 1, wherein a wall web is formed in an angular region of 75° to 105°, measured from the exhaust side intersection lying at 0° of said cylinder inner wall with said plane of symmetry, between said inflow openings of said exhaust channels.

5. The cylinder according to claim 3, wherein said wall web is formed in an angular region of 80° to 100°.

6. The cylinder according to claim 1, wherein at least one line for a coolant medium is formed in an interior of at least one of said wall webs.

7. The cylinder according to claim 1, wherein said wall, in a wall region located below a wall region with said inflow openings of said exhaust channels, is formed with overflow channels opening into a cylinder chamber, said overflow channels have mouths located or formed symmetrical in relation to said plane of symmetry.

8. The cylinder according to claim 1, which further comprises a piston and a connecting rod with a big-end bearing pivotally hinged on said piston with a piston bolt extending perpendicular to said plane of symmetry.

9. The cylinder according to claim 8, wherein:

a shaft wall of said piston in a region of said big-end bearing carried by said piston bolt is formed, at least on one side, with a mounting recess for installation of said piston bolt; and a wall web is formed in the angular region of said cylinder inner wall that is swept by the mounting recess during a piston stroke.

10. The cylinder according to claim 7, wherein at least the wall web closest to an exhaust line, or at least the two wall webs closest to said exhaust line, viewed in the longitudinal direction of the cylinder, extend both in the wall region with said inflow openings of said exhaust channels and in the wall region with the mouths of said overflow channels.

11. The cylinder according to claim 1, wherein an inflow direction of at least one of said exhaust channels and/or an outflow direction of at least one of said overflow channels is tilted at an angle in a direction towards an end of the cylinder chamber on a combustion chamber side, said tilt angle increasing successively as a distance from said exhaust line increases.

12. The cylinder according to claim 11, wherein said tilt angle of an overflow channel lying below said exhaust line is $-3° \leq N \leq +5°$, preferably $-2° \leq N \leq +3°$, and/or said tilt angle for said exhaust channel or channels and/or said overflow channels lying closest to said exhaust line is $0° \leq N \leq 7°$, for the next exhaust channels and/or overflow channels along the periphery said tile angle N is $0° \leq N \leq 20°$, and said tilt angle for further overflow channels lying farther away from said exhaust line is $50° \leq N \leq 70°$.

13. The cylinder according to claim 12, wherein said tilt angle of the overflow channel lying below said exhaust line is $-2° \leq N \leq +3°$, and/or said tilt angle for said exhaust channel or channels and/or overflow channels lying closest to said exhaust line is $0° \leq N \leq 5°$, said tile angle for the next exhaust channels and/or overflow channels along the periphery is $5° \leq N \leq 17°$, and said tilt angle for further overflow channels lying farther away from said exhaust line is $50° \leq N \leq 70°$.

14. The cylinder according to claim 1, wherein an edge lying on a combustion chamber side of said outflow openings of said exhaust channels is rounded with a rounding radius of between 0.4 and 1 mm.

15. The cylinder according to claim 14, wherein said rounding radius is between 0.4 and 0.6 mm.

16. The cylinder according to claim 1, which comprises a displaceable slide valve protruding in the exhaust channel lying in said plane of symmetry or in the two exhaust channels lying closest to said plane of symmetry, said displaceable slide valve having an end edge protruding into the respective channel and defining an adjustable exhaust control edge.

17. The cylinder according to claim 1, which comprises a piston with a piston skirt, said piston skirt having a skirt length in the region of the mouths of said overflow channels lying below said exhaust line is smaller by a height of the mouths of said overflow channels than said inner wall surface of said cylinder swept by said piston skirt.

18. The cylinder according to claim 1, wherein:

mouths of said overflow channels are disposed in the cylinder chamber below the wall region with said inflow openings of said exhaust channels, wherein at least the mouths of said overflow channels are located or formed symmetrically in relation to said plane symmetry;

the inflow direction of at least one exhaust channel and/or the outflow direction of at least one overflow channel is tilted at an angle in a direction towards an end of the cylinder chamber on a combustion chamber side, said tilt angle of the inflow direction or outflow direction increasing successively with a distance from said exhaust line; and the tilt angle of an overflow channel lying below said exhaust line is $-3° \leq N \leq +5°$ relative to a plane standing perpendicular to said cylinder axis.

19. The cylinder according to claim 18, wherein the tilt angle of the overflow channel lying below said exhaust line is $-2° \leq N \leq +3°$.

20. A two-stroke engine, comprising at least one externally fired cylinder according to claim 1.

* * * * *